US007966749B2

(12) United States Patent
Montross

(10) Patent No.: US 7,966,749 B2
(45) Date of Patent: Jun. 28, 2011

(54) MULTI-CHAMBER CUSHION FOR FOOTWEAR

(75) Inventor: Matt Montross, Middleboro, MA (US)

(73) Assignee: Reebok International Ltd., Canton, MA (US)

( * ) Notice: Subject to any disclaimer, the term of this patent is extended or adjusted under 35 U.S.C. 154(b) by 762 days.

(21) Appl. No.: 12/028,598

(22) Filed: Feb. 8, 2008

(65) Prior Publication Data

US 2009/0199430 A1 Aug. 13, 2009

(51) Int. Cl.
*A43B 5/00* (2006.01)

(52) U.S. Cl. ..... 36/29; 36/3 B; 36/35 B

(58) Field of Classification Search ..... 36/3 R, 36/3 B, 29, 35 B, 97
See application file for complete search history.

(56) References Cited

U.S. PATENT DOCUMENTS 1,069,001 A * 7/1913 Guy ..... 36/29
1,711,270 A * 4/1929 Litle, Jr. ..... 138/42
4,635,384 A * 1/1987 Huh et al. ..... 36/29
5,335,382 A * 8/1994 Huang ..... 5/655.3
5,558,395 A * 9/1996 Huang ..... 297/199
5,771,606 A 6/1998 Litchfield et al.
5,896,681 A * 4/1999 Lin ..... 36/28
5,896,682 A * 4/1999 Lin ..... 36/29
6,354,020 B1 3/2002 Kimball et al.
6,453,577 B1 9/2002 Litchfield et al.
6,505,420 B1 * 1/2003 Litchfield et al. ..... 36/29
6,745,499 B2 * 6/2004 Christensen et al. ..... 36/29
2003/0101619 A1 * 6/2003 Litchfield et al. ..... 36/29

* cited by examiner

*Primary Examiner* — Marie Paterson
(74) *Attorney, Agent, or Firm* — Sterne, Kessler, Goldstein & Fox P.L.L.C.

(57) ABSTRACT

A resilient cushioning device for incorporation in an article of footwear has chambers interconnected by a corrugated passageway. The passageway fluidly connects a heel region having at least one chamber and a forefoot region having at least one chamber. The corrugation of the passageway make the passageway adjustable so that the resilient cushioning device fits a plurality of different articles of footwear. For example the passageway is adjustable so that it is expandable lengthwise so that the resilient cushioning device fits a plurality of sizes of articles and/or so that it bends sideways so that the resilient cushioning device fits a plurality of configurations of articles of footwear.

15 Claims, 2 Drawing Sheets

MULTI-CHAMBER CUSHION FOR FOOTWEAR

BACKGROUND OF THE INVENTION

1. Field of the Invention

This invention relates generally to footwear, and more particularly to a multichamber resilient cushion having chambers interconnected by a corrugated passageway for an article of footwear.

2. Background Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the Achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part by incorporating a sole (typically including, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe. The overriding problem of these devices is that the cushioning means are inflated with a pressurized gas which is forced into the cushioning means, usually through a valve accessible from the exterior of the shoe.

There are several difficulties associated with using a pressurized fluid within a cushioning device. Most notably, it may be inconvenient and tedious to constantly adjust the pressure or introduce a fluid to the cushioning device. Moreover, it is difficult to provide a consistent pressure within the device thereby giving a consistent performance of the shoes. In addition, a cushioning device which is capable of holding pressurized gas is comparatively expensive to manufacture. Further, pressurized gas tends to escape from such a cushioning device, requiring the introduction of additional gas. Finally, a valve which is visible to the exterior of the shoe negatively affects the aesthetics of the shoe, and increases the probability of the valve being damaged when the shoe is worn.

A cushioning device which, when unloaded contains air at ambient pressure provides several benefits over similar devices containing pressurized fluid. For example, generally a cushioning device which contains air at ambient pressure will not leak and lose air, because there is no pressure gradient in the resting state. The problem with many of these cushioning devices is that they are either too hard or too soft. A resilient member that is too hard may provide adequate support when exerting pressure on the member, such as when running. However, the resilient member will likely feel uncomfortable to a wearer when no force is exerted on the member, such as when standing. A resilient member that is too soft may feel cushy and comfortable to a wearer when no force is exerted on the member, such as when standing or during casual walking. However, the member will likely not provide the necessary support when force is exerted on the member, such as when running. Further, a resilient member that is too soft may actually drain energy from the wearer.

In addition, in current cushioning devices separate cushioning devices need to be manufactured for different articles of footwear. For example, a separate cushioning device needs to be manufactured for each size of shoe. Also, separate cushioning devices need to be manufactured for different configurations such as the right shoe and the left shoe, as the lasts for each may be different and the cushioning devices may bend in different directions. This can become expensive, as a different mold may be needed for each size shoe and for the left shoe and the right shoe. Therefore a need exists for a resilient cushioning device that can be utilized in different shoe configurations and in different shoe sizes.

Accordingly, what is needed is a shoe which incorporates a cushioning system including a means to provide resilient support to the wearer during fast walking and running, and to provide adequate cushioning to the wearer during standing and casual walking, and for a resilient cushion that can be adjusted to fit different shoe configurations and different shoe sizes.

BRIEF SUMMARY OF THE INVENTION

The present invention according to one embodiment is related to a resilient cushioning device for incorporation in an article of footwear that has chambers interconnected by a corrugated passageway. The passageway fluidly connects a heel region having at least one chamber and a forefoot region having at least one chamber. The corrugation of the passageway makes the passageway adjustable so that the cushioning device fits a plurality of different articles of footwear.

The present invention according to another embodiment is related to a resilient cushioning device for incorporation in an article of footwear having chambers interconnected by a corrugated passageway. The passageway fluidly connects a first plurality of chambers and a second plurality of chambers. The corrugation of the passageway makes the passageway adjustable so that the cushioning device fits a plurality of different articles of footwear.

In embodiments of the present invention, the passageway is adjustable so that it is expandable lengthwise so that the cushioning device fits a plurality of sizes of articles and/or so that it bends sideways so that the cushioning device fits a plurality of configurations of articles of footwear.

BRIEF DESCRIPTION OF THE DRAWINGS/FIGURES

The accompanying drawings are incorporated herein and form part of the specification. Together with the detailed description, the drawings further serve to explain the principles of and to enable a person skilled in the relevant art(s) to make and use the devices and methods presented herein.

DETAILED DESCRIPTION OF THE INVENTION

Figure 1:
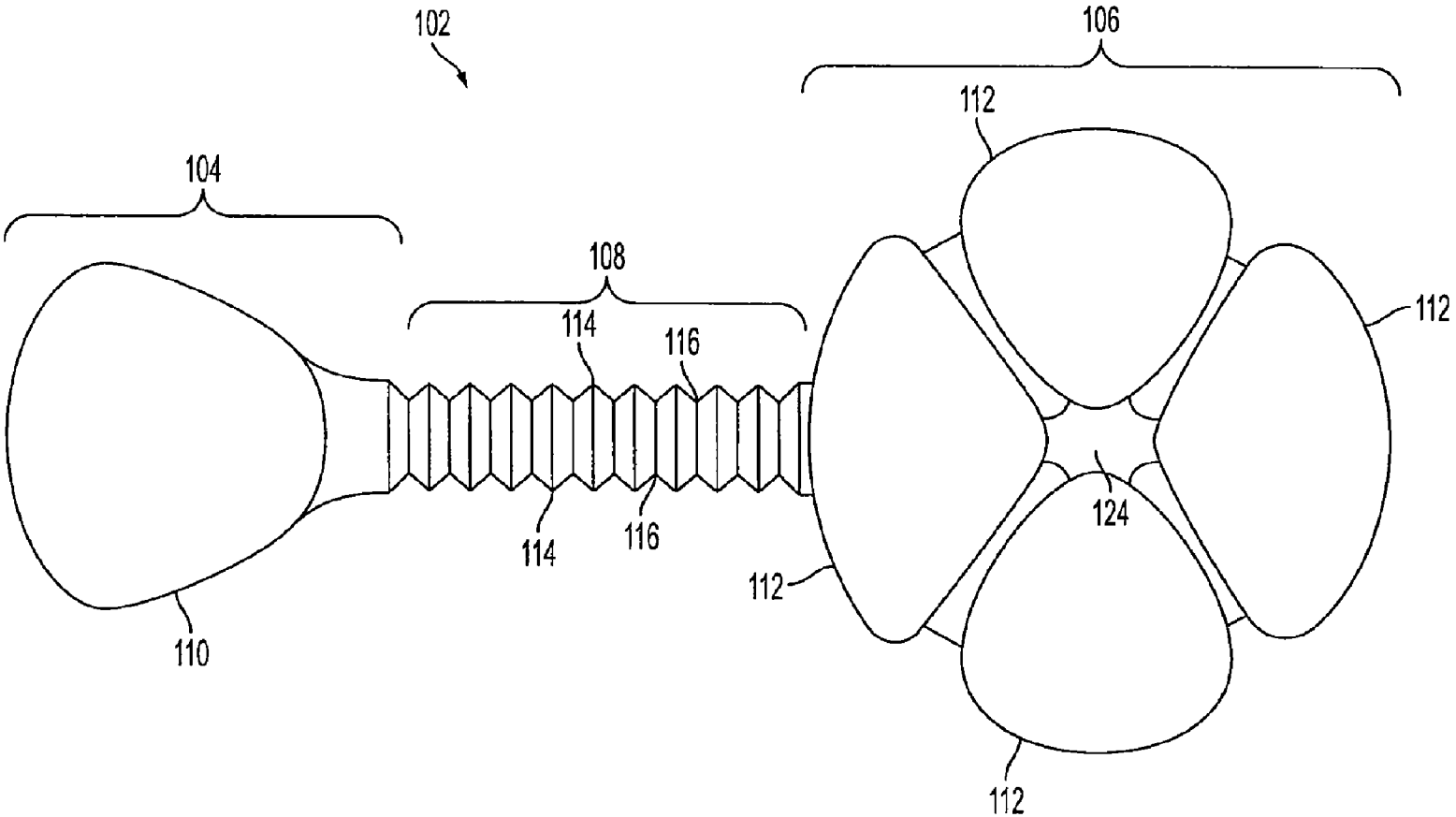
FIG. 1 is a top plan view of a cushioning device according to an embodiment of the present invention.

Preferred embodiments of the present invention are now described with reference to the Figures, in which like reference numerals are used to indicate identical or functionally similar elements. Also in the Figures, the left most digit of each reference numeral corresponds to the Figure in which the reference numeral first appears. While specific configurations and arrangements are discussed, it should be understood that this is done for illustrative purposes only. A person skilled in the relevant art will recognize that other configurations and arrangements can be used without departing from the spirit and scope of the present invention. It will be apparent to a person skilled in the relevant art that the present invention can also be employed in a variety of other devices and applications.

Figure 2:
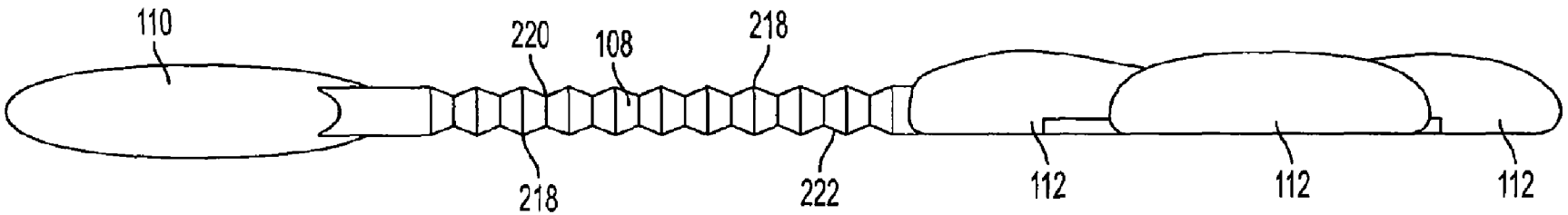
FIG. 2 is a side view of the cushioning device according to an embodiment of the present invention.

Referring now to FIGS. 1-2, a resilient cushioning device 102 is shown. Cushioning device 102 provides continuously modifying cushioning to an article of footwear, such that a wearer's stride forces air within resilient cushioning device 102 to move in a complementary manner with respect to the stride.

FIG. 1 is a top plan view of resilient cushioning device 102 in accordance with an embodiment of the present invention. In a preferred embodiment, FIG. 1 in fact can be either a top or bottom plan view, as the top and bottom of resilient cushioning device 102 are substantially the same. FIG. 2 is a side view of resilient cushioning device 102.

Resilient cushioning device 102 is a three-dimensional structure formed of a suitably resilient material so as to allow resilient cushioning device 102 to compress and expand while resisting breakdown. The resilient cushioning device 102 may be formed from a thermoplastic elastomer or a thermoplastic olefin. Suitable materials used to form resilient cushioning device 102 may include various ranges of the following physical properties:

| | | Preferred Lower Limit | Preferred Upper Limit |
|---|---|---|---|
| Density (Specific Gravity in g/cm$^3$) | | 0.80 | 1.35 |
| Modulus @ 300% Elongation (psi) | | 1,000 | 6,500 |
| Permanent Set @ 200% Strain (%) | | 0 | 55 |
| Compression Set 22 hr/23° C. | | 0 | 45 |
| Hardness | Shore A | 70 | — |
| | Shore D | 0 | 55 |
| Tear Strength (KN/m) | | 60 | 600 |
| Permanent Set at Break (%) | | 0 | 600 |

Many materials within the class of Thermoplastic Elastomers (TPEs) or Thermoplastic Olefins (TPOs) can be utilized to provide the above physical characteristics. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B. F. Goodrich under the tradename ESTANE and a TPU available from BASF under the tradename ELASTOLLAN provide the physical characteristics described above. Additionally, resilient cushioning device 102 can be formed from natural rubber compounds. However, these natural rubber compounds currently cannot be blow molded as described below. As will be apparent to those of ordinary skill in the art, other similar materials may be used without departing from the scope and spirit of the present invention.

A preferred method of manufacturing resilient cushioning device 102 is via extrusion blow molding. It will be appreciated by those skilled in the art that the blow molding process is relatively simple and inexpensive. Further, each element of resilient cushioning device 102 of the present invention is created during the same molding process. This results in a unitary, "one-piece" resilient cushioning device 102, wherein all the unique elements of resilient cushioning device 102 discussed herein are accomplished using the same mold. Resilient cushioning device 102 can be extrusion blow molded to create a unitary, "one-piece" component, by any one of the following extrusion blow molding techniques: needle or pin blow molding with subsequent sealing, air entrapped blow molding, pillow blow molding or frame blow molding. These blow molding techniques are known to those skilled in the relevant art.

Alternatively, other types of blow molding, such as injection blow molding and stretch blow molding may be used to form resilient cushioning device 102. Further, other manufacturing methods can be used to form resilient cushioning device 102, such as, for example, thermoforming and sealing, or vacuum forming and sealing.

Resilient cushioning device 102 is a hollow structure preferably filled with ambient air. In one embodiment, resilient cushioning device 102 is impermeable to air; i.e., hermetically sealed, such that it is not possible for the ambient air disposed therein to escape upon application of force to resilient cushioning device 102. Naturally, diffusion may occur in and out of resilient cushioning device 102. The unloaded pressure within resilient cushioning device 102 is preferably equal to ambient pressure. Accordingly, resilient cushioning device 102 may retain its cushioning properties throughout the life of the article of footwear in which it is incorporated. If resilient cushioning device 102 is formed by air entrapment extrusion blow molding, the air inside resilient cushioning device 102 may be slightly higher than ambient pressure (e.g., between 1-5 psi above ambient pressure).

As can be seen with reference to FIG. 1, resilient cushioning device 102 is preferably a unitary member comprising three distinct components: a heel portion 104, a forefoot portion 106, and a central connecting passageway 108. Heel portion 104 is generally shaped to conform to the outline of the bottom of an individual's heel, and is disposed beneath the heel of a wearer when resilient cushioning device 102 is incorporated within a shoe. In one embodiment, as shown in FIG. 1, heel portion 104 includes a single heel chamber 110; however, this is merely exemplary and the heel portion 104 can include a plurality of fluidly interconnected heel chambers as disclosed in U.S. Pat. No. 6,845,573 to Litchfield et al., the disclosure of which is hereby incorporated in its entirety by reference thereto.

Disposed opposite heel portion 104 is forefoot portion 106. Forefoot portion 106 is generally shaped to conform to the forefoot or metatarsal area of a foot, and is disposed beneath a portion of the forefoot of a wearer when incorporated within a shoe. In one embodiment, as shown in FIG. 1, forefoot portion 106 includes a plurality of interconnected forefoot chambers 112. The arrangement of forefoot portion 106 in FIG. 1 is merely exemplary and can include a single forefoot chamber or a plurality of forefoot chambers in various configurations as disclosed in U.S. Pat. No. 6,845,573 to Litchfield et al. Preferably, the volume of air within the chambers of forefoot portion 112 is substantially the same as or slightly less than the volume of air within the chambers of heel portion 104.

Central connecting passageway 108 comprises an elongated passage which fluidly connects heel portion 104 to forefoot portion 106. Central connecting passageway 108 is corrugated to have ridges 114 along side surfaces 116 of passageway 108 and to have ridges 218 along upper surface 220 and lower surface 222 of passageway 108. Having central connecting passageway 108 corrugated allows resilient cushioning device 102 to be adjusted to fit different shoe configurations and different shoe sizes. For example, ridges 114 permit resilient cushioning device 102 to be bent or flexed sideways, either left or right, along passageway 108 to accommodate differently configured lasts, such as ones for a left shoe and a right shoe. Ridges 218 also permit resilient cushioning device 102 to be bent or flexed upwards or downwards such that the entire resilient cushioning device 102 is not in the same plane. For example, heel region 104 can be in a different plane than forefoot region 106. Ridges 114 and 218 also permit passageway 108 to be extended along its length to a point where ridges 114 and 218 are no longer distinguishable so that the same resilient cushioning device 102 can be used for different sized shoes. All of the above features permit a single resilient cushioning device to be utilized in a plurality of configurations and sizes, thereby reducing the number of different configured devices needed and the number of different mold configurations needed.

Ridges 114 and 218 help increase the turbulence of air flow within resilient cushioning device 102. As air passes through passageway 108, ridges 114 and 218 help increase the turbulence within the air flow between heel portion 104 and forefoot portion 106. The turbulence slows down air flow into forefoot portion 106 from heel portion 104 when the heel portion is depressed, thereby preventing any potential damage to cushioning device 102 from a rush of air to forefoot region 106. In a preferred embodiment, the turbulence in the air flow is further increased as the air passes through an impedance means located in passageway 108. The impedance means can take any form know in the art, such as that disclosed in U.S. Pat. No. 6,845,573 to Litchfield et al, and that disclosed in U.S. Pat. No. 6,505,420 to Litchfield et al., the disclosure of which is also hereby incorporated in its entirety by reference thereto. The impedance means restricts the air flow through passageway 108, thereby increasing the turbulence of the air.

The structure of the ridges and any impedance means of embodiments of the present invention are accomplished during the preferred blow-molding manufacturing process described above. As previously indicated, the resilient cushioning device is formed of a suitably resilient material so as to enable heel and forefoot portions to compress and expand. The central connecting passageway along with the ridges and impedance means are preferably formed of the same resilient material as the two oppositely-disposed portions adjacent its ends and should have an appropriate degree of flexibility that will permit the adjustments in configuration of the connecting passageway 108.

In one embodiment, passageway 108 connects to one of forefoot chambers 112 and the remainder of the forefoot chambers 112 are fluidly connected thereto via a central hub 124. Accordingly, air enters forefoot region 108 via the forefoot chamber connected to passageway 108 and passes through to the remaining forefoot chambers through central hub 124. Similarly air leaves forefoot region 108 through the forefoot chamber connected to passageway 108 and out into passageway 108. It is noted that this configuration for fluidly connecting the forefoot chambers to each other and the connecting passageway is merely exemplary. Other configurations are possible such as the connecting passageway having branches to different forefoot chambers and other configurations disclosed in U.S. Pat. No. 6,845,573 to Litchfield et al.

The resilient cushioning device of the present invention may be incorporated within a shoe, wherein the resilient cushioning device is disposed within a sole of a shoe between an outsole and a midsole or alternatively may be disposed within a cavity formed within a midsole.

It is to be appreciated that the Detailed Description section, and not the Summary and Abstract sections, is intended to be used to interpret the claims. The Summary and Abstract sections may set forth one or more but not necessarily all exemplary embodiments of the present invention as contemplated by the inventor(s), and thus, are not intended to limit the present invention and the appended claims in any way.

What is claimed is:

1. A cushioning device for an article of footwear comprising:

at least one heel chamber;

at least one forefoot chamber; and a passageway fluidly connecting said at least one heel chamber and said at least one forefoot chamber having an upper surface, a lower surface, a left side surface, and a right side surface, wherein said passageway is corrugated and adjustable so that said passageway is at least one of (a) expandable lengthwise and (b) bendable sideways along said left side surface or said right side surface so that said cushioning device is adapted to fit a plurality of articles of footwear.

2. The cushioning device of claim 1, wherein said passageway includes a plurality of ridges formed on the upper surface and the lower surface.

3. The cushioning device of claim 1, wherein said passageway includes a plurality of ridges formed on at least one of said left side surface and said right side surface.

4. The cushioning device of claim 1, wherein said cushioning device contains air at ambient pressure.

5. The cushioning device of claim 1, wherein said cushioning device contains air at slightly above ambient pressure.

6. The cushioning device of claim 1, further comprising impedance means, disposed within said passageway, for restricting a flow of air between said at least one heel chamber and said at least one forefoot chamber.

7. A cushioning device for an article of footwear comprising:

a plurality of first chambers fluidly interconnected to each other;

a plurality of second chambers fluidly interconnected to each other; and a connecting passageway connecting said plurality of first chambers and said plurality of second chambers having an upper surface, a lower surface, a left side surface, and a right side surface, wherein said passageway has a plurality of ridges formed thereon such that the cushioning device is at least one of (a) expandable lengthwise and (b) bendable sideways along said left side surface or said right side surface so that the cushioning device fits a plurality of different articles of footwear.

8. The cushioning device of claim 7, wherein said cushioning device contains air at ambient pressure.

9. The cushioning device of claim 7, wherein said cushioning device contains air at slightly above ambient pressure.

10. The cushioning device of claim 7, further comprising impedance means, disposed within said passageway, for restricting a flow of air between said plurality of first chambers and said plurality of second chambers.

11. The cushioning device of claim 7, wherein said first plurality of chambers is heel chambers.

12. The cushioning device of claim 7, wherein said second plurality of chambers is forefoot chambers.

13. The cushioning device of claim 7, wherein said connecting passage is directly fluidly interconnected to only one chamber of said first plurality of chambers.

14. An article of footwear, comprising:

a sole having a forefoot portion and a heel portion;

at least one forefoot chamber disposed in the forefoot portion;

at least one heel chamber disposed in the heel portion; and a corrugated passageway fluidly connecting said at least one heel chamber and said at least one forefoot chamber having an upper surface, a lower surface, a left side surface and a right side surface wherein said passageway has a plurality of ridges formed thereon so that said passageway is at least one of (a) expandable lengthwise and (b) bendable sideways along said left side surface or said right side surface.

15. The article of footwear of claim 14, further comprising impedance means, disposed within said passageway, for restricting a flow of air between said plurality of first chambers and said plurality of second chambers.

* * * * *